US005448234A

United States Patent [19]

Harwood

[11] Patent Number: 5,448,234

[45] Date of Patent: Sep. 5, 1995

[54] LOGICAL LIGHT CONTROL FOR SAILING VESSELS

[76] Inventor: David C. Harwood, P.O. Box 371, Woodstown, N.J. 08098

[21] Appl. No.: 180,271

[22] Filed: Jan. 12, 1994

[51] Int. Cl.[6] ..... G08B 23/00

[52] U.S. Cl. ..... 340/984; 114/39.1; 362/61

[58] Field of Search ..... 340/984, 985, 332; 114/39.1, 270; 362/61; 116/26

[56] References Cited

U.S. PATENT DOCUMENTS 3,431,408 3/1969 Roosevelt ..... 340/984
4,602,584 7/1986 North et al. ..... 114/39.1

FOREIGN PATENT DOCUMENTS 0166130 7/1987 Japan ..... 340/985

*Primary Examiner*—Brent Swarthout

[57] ABSTRACT

It has always been possible, due to operator fatigue or forgetfulness, for a sailing vessel to display a well-defined combination of navigation lights which is incorrect for the current operating mode of the vessel. Improper combinations are also possible: many combinations are undefined and therefore meaningless. With the advent of the Tri-color and Bi-color Masthead Running Lights, additional improper combinations of lights became possible. The importance of displaying correct lights is not simply etiquette—communication of the vessel's current operating status to other persons in the immediate vicinity has safety implications. The intent of this invention is to improve the method by which the operator selects the desired light combination, thereby eliminating the possibility of improper light combinations and reducing the probability that the vessel will display a currently incorrect light combination.

20 Claims, 4 Drawing Sheets

LOGICAL LIGHT CONTROL FOR SAILING VESSELS

BACKGROUND

1. Field of the Invention

The present invention relates in general to control of navigation lights aboard a sailing vessel, and specifically to improving the method of selecting the desired correct combination.

2. Prior Art

The Deck-level Running Lights (DRL) are a group of lights which must be displayed in conjunction and are typically controlled by a single switch. The Steaming Light, Anchor Light, and Masthead Running Lights are individual lights. The Steaming Light (SL) is displayed only in conjunction with the Deck-level Running Lights and no others when the vessel is being operated under auxiliary (motor) power. The Anchor Light (AL) must not be displayed in conjunction with any other light. The Masthead Running Lights are used only when the vessel is operating under sail without auxiliary power. The Tri-color Masthead Running Light (TMRL) must not be displayed in conjunction with any other light, and the Bi-color Masthead Running Light (BMRL) must be displayed in conjunction with the Deck-level Running Lights and no others.

Under existing wiring practice, an auxiliary (motorized) sailing vessel equipped with a fixed (permanently-mounted) Anchor Light and a Masthead Running Light would have (among others) four light switches on the electric panel: Deck-level Running Lights, Steaming Light, Anchor Light, and Masthead Running Light. The Anchor Light and the Masthead Running Light, while retaining their separate functions, might be combined in a single fixture and be controlled by a single switch to eliminate the possibility of both being lit at the same time. If the vessel is wired with four on-off switches, there would be a total of sixteen possible switch settings, only five of which result in a proper display of lights it has not been a common practice for a vessel to be equipped with both Tri-color and Bi-color Masthead Running Lights, and the author is unaware of any manufacturer offering a fixture combining both Tri-color and Bi-color Masthead Running Lights. If the above vessel were equipped with both types of masthead light and wired with five on-off switches, there would be a total of thirty-two possible combinations, of which six are proper and twenty-six are improper.

A two-wire installation of the Anchor Light and the Masthead Running Light is often effected by using a pair of diodes at the masthead to eliminate the weight of a common mast return wire running the length of the mast. If the vessel has a steaming light and/or a foredeck light and/or spreader lights, the advantage over using a common mast return is reduced to the elimination of a single strand of wire in the top half of the mast. If a masthead (emergency) strobe light is included, there is no advantage. Use of a common mast return also eliminates two possible points of failure—the diodes—from the masthead. The possibility remains for a Tri-color Masthead Running Light or Anchor Light to be displayed improperly in combination with Deck-level Running Lights and/or Steaming Light.

At least one yacht manufacturer (Cabo Rico) has attempted to simplify the light controls by offering a single switch with positions which select Sailing (Tri-color Masthead Running Light), Off, and Power (Steaming Light and Deck-level Running Lights) modes. Several purchasers of this system have requested addition of a switch which disables the Steaming Light to allow use of the Deck-Level Running Lights while sailing. Because the Deck-level Running Lights and the Steaming Light are wired as a single circuit, this switch is located at the base of the mast. Due to location of the added switch and the Sailing-Off-Power switches in different places, an operator might select the Power setting and forget that the Steaming Light had previously been disabled. A Bi-color Masthead Running Light could be added to this arrangement by replacing the Steaming Light switch at the base of the mast with a single-pole double-throw switch (with center off) to select the SL or the BMRL. The location of the switch would still be awkward, and the Anchor Light is not included in this system.

It is possible under prior art to place all navigation lights under control of a microprocessor programed to allow only proper combinations of lights. The author is unaware of such a system having been implemented on private recreational vessels, but recognizes the possible advantages for larger commercial vessels.

SUMMARY OF THE INVENTION

The object of this invention is to improve the method of controlling the navigation lights aboard a sailing vessel in such manner as to 1. eliminate the possibility of display of improper combinations of navigation lights,
2. simplify the operator's task in selecting the desired correct combination of lights,
3. reduce the probability that the vessel will display a currently incorrect combination of navigation lights and
4. encourage installation of navigation light systems including both Tri-color and Bi-color Masthead Running Lights.

This object is achieved, according to the present invention, by controlling up to five light circuits by means of a maximum of three operator controlled switches which have no combinations resulting in an improper combination of lights. Moreover, these three switches may be physically arranged in such a manner that their functions are easily remembered, enabling the operator to use them in the dark without having to read the legends printed beside them.

Often, using the current invention, throwing a single switch accomplishes a light change that would have involved three switches under prior art. When anchoring under power, one must extinguish the Deck-level Running Lights and Steaming Light, and light the Anchor Light. If mode switches are used, throwing a single switch from "Under Way" to "Anchored" will take care of all three lights. When sailing under Tri-color Masthead Running Light and engaging the motor, one must extinguish the Masthead Running Light and light the Deck-level Running Lights and Steaming Light. Using the current invention, it is only necessary to throw a single switch from "Sail" to "Power". If the proposed "Automatic" feature is in use, the operator need not touch the switches in the second example.

The option of carrying both Tri-color and Bi-color Masthead Running Lights, previously unheard-of, is now available with greater simplicity of operation than was previously available with a single masthead running light. This offers the operator improved ability to tailor the light display (and power consumption) more closely to the requirements of the immediate situation.

DETAILED DESCRIPTION of the INVENTION

Figure 1:
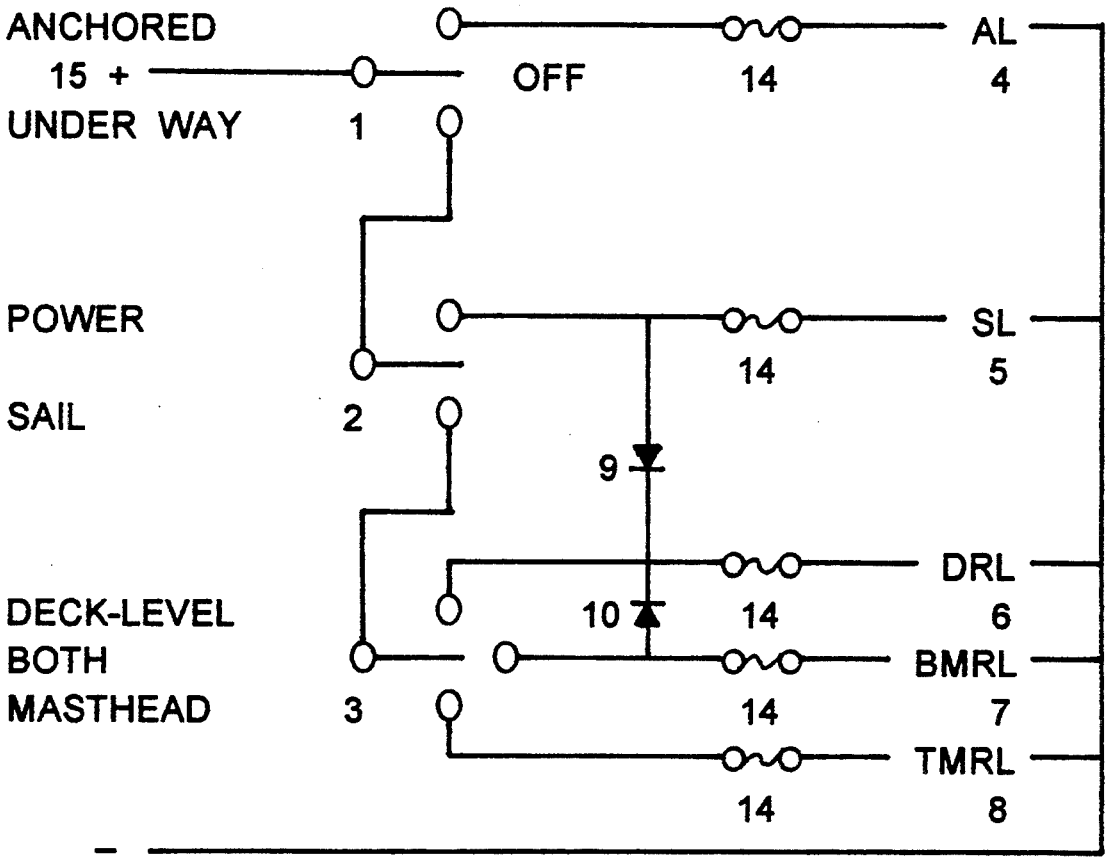
FIG. 1 shows a schematic of mode Switches with Diodes.

FIG. 1 shows a preferred embodiment of an improved method for controlling the navigation lights of a sailing vessel. This method uses three operator controlled selection mechanisms 1, 2 & 3 and two diodes 9 & 10 to connect the vessel's electrical power supply 15 with the Anchor Light 4, Steaming Light 5, Deck-level Running Lights 6, Bi-color Masthead Running Light 7, and Tri-color Masthead Running Light 8 without the possibility of displaying an improper combination of lights. (The possibility of operator error in selecting the currently correct combination remains.) Presence of Deck-level Running Lights, Bi-color Masthead Running Light and Tri-color Masthead Running Light means this vessel is equipped to display all three running light combinations appropriate for a sailing vessel.

These operator controlled selection mechanisms should be viewed not as light switches, but as mode switches. The first of these mode switches 1 (single-pole double-throw with center "off") allows mutually exclusive selection of one of three modes—"OFF", "ANCHORED", or "UNDER WAY". "Off" turns all navigation lights off, and "Anchored" lights only the Anchor Light. If "Anchored" or "Off", the remaining two switches may be ignored If "Under Way", the second mode switch 2 (single-pole double-throw with no center position) allows mutually exclusive selection of one of two modes—"POWER" or "SAIL". If under "Power", the remaining switch may be ignored, as Deck-level Running Lights are automatically selected along with the Steaming Light If under "Sail", the third mode switch 3 (single-pole three-throw) allows mutually exclusive selection of one of three modes—"MASTHEAD RUNNING LIGHT" (TMRL 8), "DECK-LEVEL RUNNING LIGHTS" (DRL 6) or "BOTH" (DRL 6 and BMRL 7).

Figure 2:
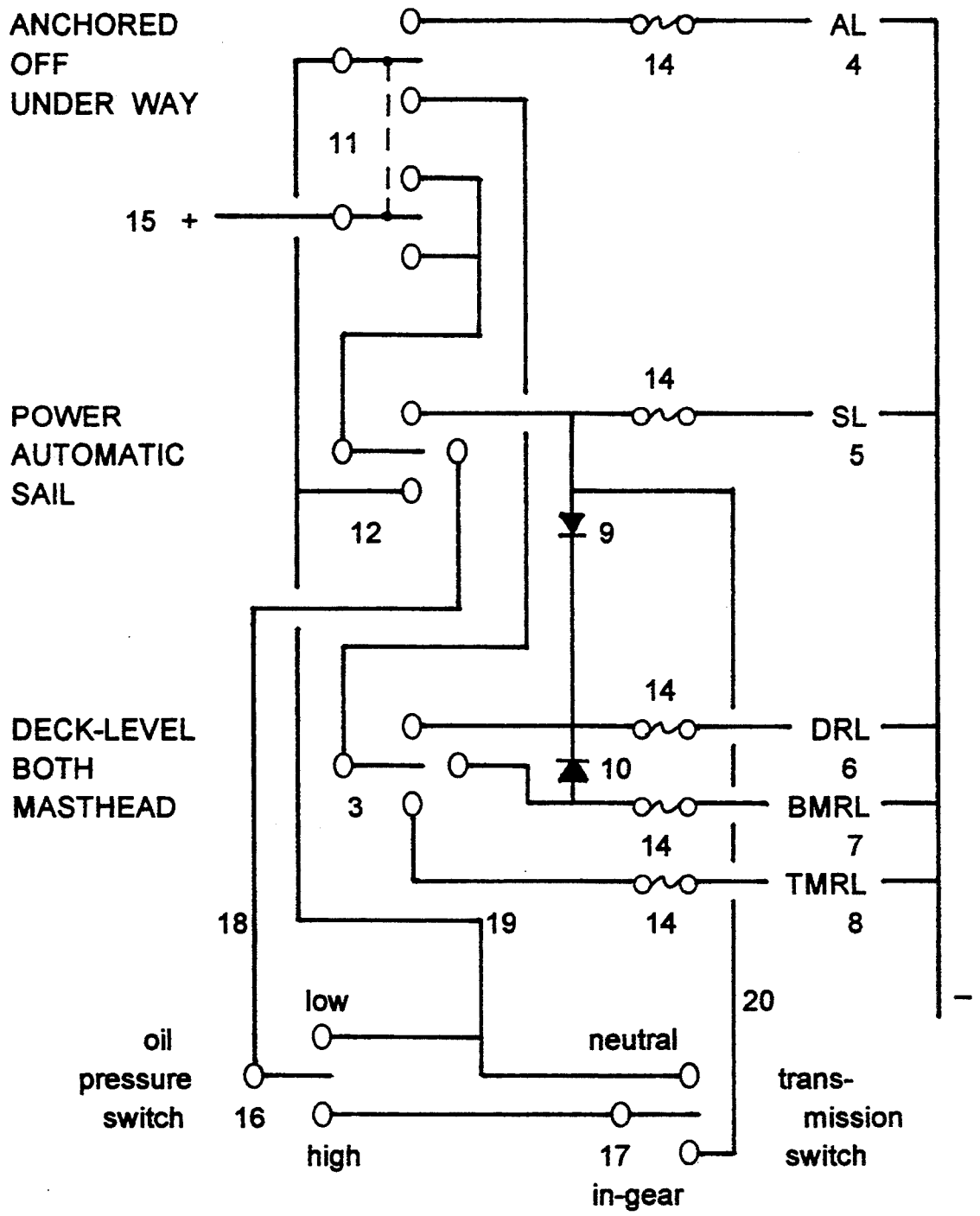
FIG. 2 shows a schematic of mode Switches with Diodes and Automatic Feature.

An optional third position of the second mode switch would reduce the probability of operator error in selection of the currently correct combination. This position selects "AUTOMATIC" mode, in which the system selects "Power" when the operator engages the auxiliary propulsion system (APS) for the purpose of propelling the vessel. FIG. 2 shows a preferred method of using a three-throw version of the second mode switch 12 and switching circuitry connected to the auxiliary propulsion system (APS switches). The vessel's electrical power supply is connected through an additional pole of the first mode switch 11 to the common terminal of the second mode switch 12. The supply line 18 connects the additional position of the second mode switch 12 to an oil-pressure switch 16 on the engine (set to close when oil pressure rises to a point slightly below operating pressure to allow for fluctuations) in series with a neutral-position switch 17 on the transmission or the shift linkage. The APS-in-use return 20 from the APS switches and selection of "Power" mode each select operation of the SL 5 and DRL 6. The APS-not-in-use return 19 from the APS switches and selection of "Sail" mode each enable selection of the anchor light or one of the running light combinations appropriate for a sailing vessel. Selection of "Sail" mode additionally prevents selection of the SL 5 and DRL 6 by the APS switches. Input from both components of the APS is recommended in order to allow use of either component for other purposes (running the engine to charge batteries, operate engine-driven refrigeration or scuba compressor, etc.; engaging the transmission with the motor off to lock the propeller shaft) without activating the Steaming Light 4 when the APS is not engaged for the purpose of propelling the vessel.

Due to the on-on nature of these mode switches (1, 2 & 3; or 11, 12 & 3), it is suggested that the user break with the long-standing nautical convention of installing switches in a vertical column with horizontal throw (left-off-right-on). These three switches may be mounted in vertical or horizontal arrangement, but should have vertical throw and be wired as in Table 1, below. The logical progression of thought in using these three mode switches makes it easier to remember which switch controls the desired function. This makes it easier to locate the proper switch in the dark or (if the switches are located in the cabin near the companionway) when reaching into the cabin from on-deck.

The preferred installation would use toggle switches. If rotary switches are substituted, they should have knobs which allow tactile as well as visual indication of the current switch position. Press-to-select selection mechanisms should be back-lit to indicate the current selection.

TABLE 1

Logical Rules for Operation of Mode Switches

| Mode Switch | Position | Mode | Logic |
|---|---|---|---|
| 1 | up | Under Way | anchor is up |
| | center | Off | |
| | down | Anchored | anchor is down |
| 2 | up | Sail | sails are above |
| | center | Automatic | goes either way |
| | down | Power | engine is below |
| 3 | up | Mast-Head | light on above |
| | center | Both | goes both ways |
| | down | Deck-Level | lights on below |

(The schematic figures show different positions, and were drawn that way solely for simplicity.)

These operator controlled selection mechanisms (1, 2 & 3; 11, 12 & 3, etc.) and diodes (9 & 10) will operate the navigation lights (4, 5, 6, 7 & 8) in conformity with the operator's selection (and, if appropriate, the status of the auxiliary propulsion system), subject to the condition of other equipment aboard the vessel. (Note: failure of a switch, wire or bulb or the proper functioning of a fuse/circuit-breaker 14 may still cause an improper display. Frequent inspection of light fixtures is always advisable.)

Failure of a diode (9, 10) would, depending on the type of failure, cause loss of Deck-level Running Lights in "power" or "both" mode (failure to conduct) or undesired display of the Steaming Light or Bi-color Light when using Deck-level Running Lights in "sail" mode (reverse conduction). Failure of either diode in an existing two-wire installation would also result in loss of a desired light or inadvertent display of an undesired light. This system greatly simplifies the task of replacing a failed diode due to location of the diodes 9, 10 at deck level.

A very slight dimming of the Deck-level Running Lights may be noticed when operating in "power mode" or "both mode", due to voltage loss across the diodes 9, 10. Vessels with a 24-volt system father than 12-volt will suffer less dimming, since the loss is a smaller part of the full voltage.

Minimization of power consumption can be a significant consideration aboard sailing vessels. Other than voltage loss due to diodes, there is no impact on the voltage delivered to the navigation lights, and there is no additional current draw in an installation of these preferred embodiments.

ALTERNATE METHODS

Figure 3:
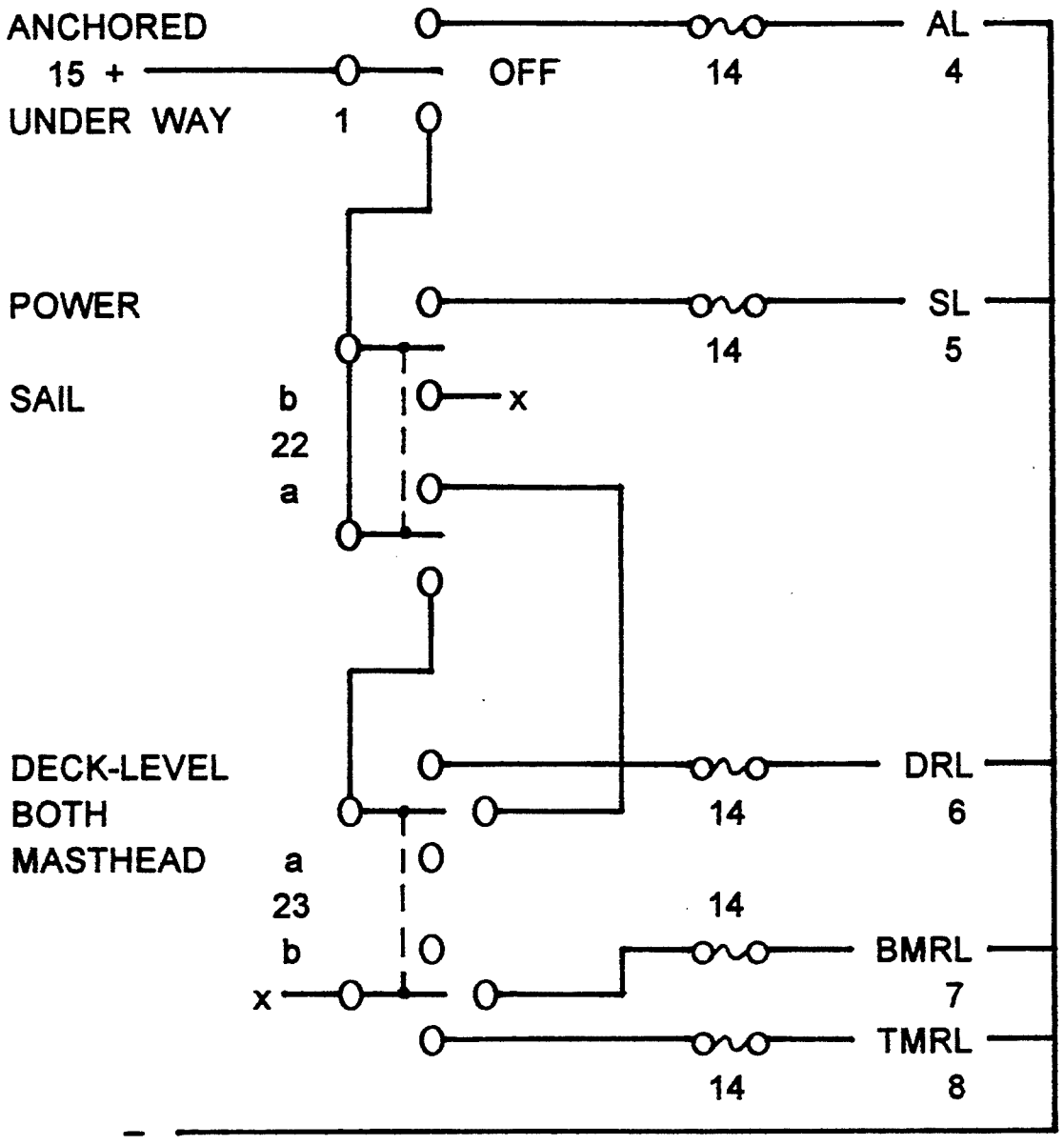
FIG. 3 shows a schematic of mode Switches without Diodes.

FIG. 3 shows a preferred embodiment of the improved method which eliminates the diodes 9 & 10 but in place of the single-pole switches 2 & 3 shown in FIG. 1 uses double-pole second and third mode switches 32 & 23. The additional poles are used to provide electrical isolation for the two lights (SL 5 and BMRL 7) which may be displayed concurrently with the DRL 6, and care must be taken to maintain two distinct channels through the two-pole switches. One channel (a) is used for DRL 6 and the other (b) for SL 5 and BMRL 7. The other two lights—AL 4 and TMRL 7—may use either channel.

Figure 4:
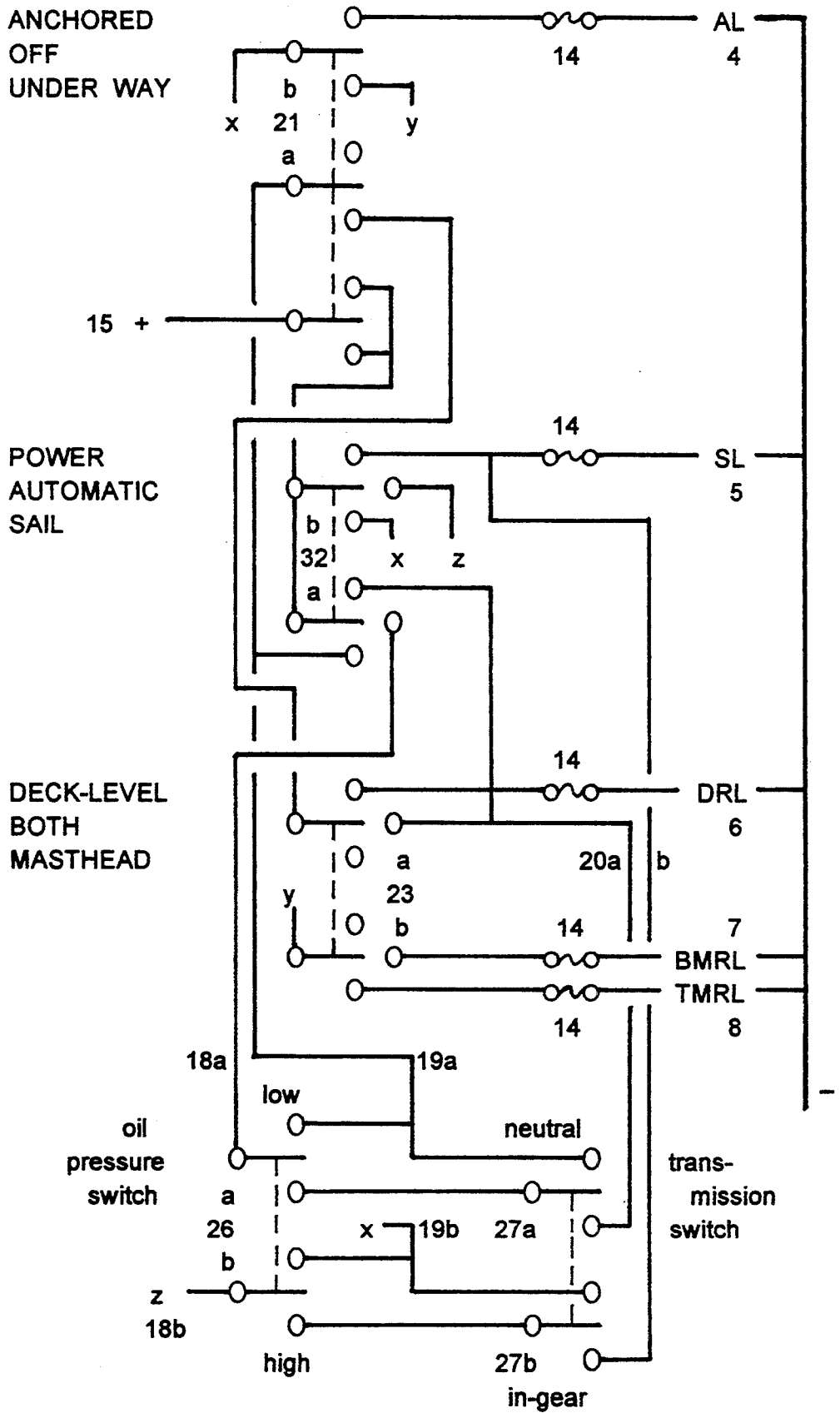
FIG. 4 shows a schematic of mode Switches and Automatic Feature without Diodes.

FIG. 4 shows a preferred non-diode embodiment of the invention with addition of the automatic feature, using double-pole APS switches 26 & 27 in place of the single-pole switches 16 & 17 in FIG. 2. Double-pole switches 22 & 23 are used in place of the single-pole second and third mode switches 12 & 3. Also shown is a triple-pole double-throw switch (with center "off") 21 which is used in place of the double-pole switch 11 as the first mode switch. Two-channel isolation in the first mode switch is required for addition of the automatic feature.

The greatest utility of this invention would be on a vessel having a fixed Anchor Light, a Steaming Light, Deck-level Running Lights, and both Tri-color and Bi-color Masthead Lights. An abbreviated system may be effected on a vessel lacking any of these elements. A vessel lacking a fixed Anchor Light would omit one position of the first mode switch. A vessel lacking a Steaming Light would omit the second mode switch and its associated diode, if the method of FIG. 1 is used. A vessel lacking any Masthead Running Light would omit the third mode switch, while a vessel having only one Masthead Running Light would omit one position of the third mode switch. In all cases, a system incorporating an "off" position in only the lowest numbered switch present would offer the greatest utility.

The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed:

1. An improved method for controlling the navigation lights of a sailing vessel including an anchor light, a steaming light and a first set of deck-level red-green-white running lights, by means of operator controlled selection mechanisms, electrically interposed between the vessel's electrical power source and the circuits of the navigation lights, which, subject to the condition of other equipment aboard the vessel, operate the navigation lights in conformity with a human operator's selection; wherein the improvement is comprised of the use of two operator controlled selection mechanisms, each of which permits a choice of mutually exclusive selections; a first said operator controlled selection mechanism being comprised of 1) a means to select operation of the anchor light and not the running lights and
2) a means to select operation of such running lights as are selected by the second operator controlled selection mechanism and not the anchor light;

and a second said operator controlled selection mechanism being comprised of 1) a means to select operation of the steaming light and (the) red-green-white deck-level running lights and
2) a means to select (a well-known) operation of red-green-white white running lights (combination) appropriate for a vessel under sail.

2. A method of claim 1 for a sailing vessel additionally equipped with a second set of red-green-white running lights mounted at the masthead wherein the improvement is additionally comprised of use of a third operator controlled selection mechanism which permits a mutually exclusive choice of selections; said third operator controlled selection mechanism being comprised of a means to select (one of the well-known) operation of the first red-green-white running light set and a means to select operation of the second red-green-white running lights (combinations appropriate for a vessel under sail).

3. An improved method for controlling the navigation lights of a sailing vessel including a steaming light, a first set of deck-level red-green-white running lights and a second set of red-green-white running lights mounted at the masthead, by means of operator controlled selection mechanisms, electrically interposed between the vessel's electrical power source and the circuits of the navigation lights, which, subject to the condition of other equipment aboard the vessel, operate the navigation lights in conformity with a human operator's selection; wherein the improvement is comprised of the use of two operator controlled selection mechanisms, each of which permits a choice of mutually exclusive selections; a first said operator controlled selection mechanism being comprised of 1) a means to select operation of the steaming light and the deck-level red-green-white running lights and
2) a means to select operation of the red-green-white running lights (combination) selected by a second said operator controlled selection mechanism;

a second said operator controlled selection mechanism being comprised of a means to select (one of the well-known) operation of the first red-green-white running light set and a means to select operation of the second red-green-white running light set (combinations appropriate for a vessel under sail).

4. An improved method for controlling the navigation lights of a sailing vessel including a steaming light, a first set of deck-level red-green-white running lights and a second set of red-green-white running lights mounted at the masthead, said vessel having an auxiliary propulsion system, by means of operator controlled selection mechanisms, electrically interposed between the vessel's electrical power source and the circuits of the navigation lights, which, subject to the condition of other equipment aboard the vessel, operate the navigation lights in conformity with a human operator's selection; wherein the improvement is comprised of the use of 1) switching circuitry connected to said auxiliary propulsion system and
2) an operator controlled selection mechanism which permits a choice of mutually exclusive selections;

said switching circuitry connected to said auxiliary propulsion system being a (well-known) means for providing an indication of the current status of said auxiliary propulsion system, (by which) such that said indication of status may be (enabled) used to control the automatic selection of operation of either 1) the (well-known) red-green-white running lights (combination) selected by said operator controlled selection mechanism when said switching circuitry provides indication that said auxiliary propulsion system is not engaged for the purpose of propelling the vessel, or
2) a steaming light and deck-level red-green-white running lights when said switching circuitry provides indication that said auxiliary propulsion system is engaged for the purpose of propelling the vessel;

said operator controlled selection mechanism being comprised of means to exclusively select (one of the well-known) operation of the first red-green-white running light set and a means to select operation of the second red-green-white running light set (combinations appropriate for a vessel under sail).

5. A method of claim 4 wherein the improvement is additionally comprised of a second operator controlled selection mechanism which permits a choice of mutually exclusive selections; said second operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of a steaming light and red-green-white deck-level running lights.

6. A method of claim 4 wherein the improvement is additionally comprised of a second operator controlled selection mechanism which permits a choice of mutually exclusive selections; a said second operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of said (well-known) running lights (combination appropriate for a vessel under sail) selected by a first said operator controlled selection mechanism of claim 4.

7. An improved method for controlling the navigation lights of a sailing vessel including an anchor light, a steaming light and a first set of deck-level red-green-white running lights, said vessel having an auxiliary propulsion system, by means of operator controlled selection mechanisms, electrically interposed between the vessel's electrical power source and the circuits of the navigation lights, which, subject to the condition of other equipment aboard the vessel, operate the navigation lights in conformity with a human operator's selection; wherein the improvement is comprised of the use of 1) switching circuitry connected to (the) said auxiliary propulsion system and
2) an operator controlled selection mechanism which permits a choice of mutually exclusive selections;

said switching circuitry connected to said auxiliary propulsion system being a (well-known) means for providing an indication of the current status of said auxiliary propulsion system, (by which) such that the indication of status may be (enabled) used to control the automatic selection of operation of either 1) (a well-known) red-green-white running lights (combination) or the anchor light as selected by said operator controlled selection mechanism when said switching circuitry provides indication that said auxiliary propulsion system is not engaged for the purpose of propelling the vessel, or
2) a steaming light and deck-level red-green-white running lights when said switching circuitry provides indication that said auxiliary propulsion system is engaged for the purpose of propelling the vessel;

said operator controlled selection mechanism being comprised of 1) a means to select operation of the anchor light and not running lights and
2) a means to select (a well-known) operation of red-green-white running lights appropriate for a vessel under sail (combination) and not the anchor light.

8. A method of claim 7 wherein the improvement is additionally comprised of a second operator controlled selection mechanism which permits a choice of mutually exclusive selections; a said second operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of a steaming light and red-green-white deck-level running lights, when running lights are selected by a first said operator controlled selection mechanism of claim 7.

9. A method of claim 7 wherein the improvement is additionally comprised of a second operator controlled selection mechanism which permits a choice of mutually exclusive selections; a said second operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) either operation of the anchor light, when anchor light is selected by a first said operator controlled selection mechanism of claim 7 or said (well-known) red-green-white running lights (combination) appropriate for a vessel under sail, when running lights are selected by a first said operator controlled selection mechanism of claim 7.

10. A method of claim 7 for a sailing vessel additionally equipped with a second set of red-green-white running lights mounted at the masthead wherein the improvement is additionally comprised of a second operator controlled selection mechanism which permits a choice of mutually exclusive selections; a second said operator controlled selection mechanism being comprised of a means to select (one of the well-known) operation of the first red-green-white running light set and a means to select operation of the second red-green-white running light set (combinations appropriate for a vessel under sail).

11. A method of claim 10 wherein the improvement is additionally comprised of a third operator controlled selection mechanism which permits a choice of mutually exclusive selections; a said third operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of a steaming light and deck-level red-green-white running lights, when running lights are selected by a first said operator controlled selection mechanism of claim 7.

12. A method of claim 10 wherein the improvement is additionally comprised of a third operator controlled selection mechanism which permits a choice of mutually exclusive selections; a said third operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and either b1) operation of the anchor light, when anchor light is selected by a first said operator controlled selection mechanism of claim 7 or b2) said (well-known) running lights (combination appropriate for a vessel under sail) selected by a second said operator controlled selection mechanism of claim 10, when running lights are selected by a first said operator controlled selection mechanism of claim 7.

13. A method of claim 7 for a sailing vessel additionally equipped with a set of red-green running lights mounted at the masthead wherein the improvement is additionally comprised of a second operator controlled selection mechanism which permits a choice of mutually exclusive selections; a second said operator controlled selection mechanism being comprised of a means to select operation of only the first red-green-white running light set and a means to select operation of both running light sets.

14. A method of claim 13 wherein the improvement is additionally comprised of a third operator controlled selection mechanism which permits a choice of mutually exclusive selections; a said third operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of a steaming light and deck-level red-green-white running lights, when running lights are selected by a first said operator controlled selection mechanism of claim 7.

15. A method of claim 13 wherein the improvement is additionally comprised of a third operator controlled selection mechanism which permits a choice of mutually exclusive selections; a said third operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and either b1) operation of the anchor light, when anchor light is selected by a first said operator controlled selection mechanism of claim 7 or b2) said running lights selected by a second said operator controlled selection mechanism of claim 13, when running lights are selected by a first said operator controlled selection mechanism of claim 7.

16. A method of claim 1 for a sailing vessel additionally equipped with a second set of red-green running lights mounted at the masthead wherein the improvement is additionally comprised of use of a third operator controlled selection mechanism which permits a mutually exclusive choice of selections; said third operator controlled selection mechanism being comprised of a means to select operation of only the first red-green-white running light set and a means to select operation of both running light sets.

17. An improved method for controlling the navigation lights of a sailing vessel including a steaming light, a first set of deck-level red-green-white running lights and a second set of red-green running lights mounted at the masthead, said vessel having an auxiliary propulsion system, by means of operator controlled selection mechanisms, electrically interposed between the vessel's electrical power source and the circuits of the navigation lights, which, subject to the condition of other equipment aboard the vessel, operate the navigation lights in conformity with a human operator's selection; wherein the improvement is comprised of the use of 1) switching circuitry connected to said auxiliary propulsion system and
2) an operator controlled selection mechanism which permits a choice of mutually exclusive selections; said switching circuitry connected to said auxiliary propulsion system being a means for providing an indication of the current status of said auxiliary propulsion system, such that said indication of status may be used to control the automatic selection of operation of either 1) the running lights selected by said operator controlled selection mechanism when said switching circuitry provides indication that said auxiliary propulsion system is not engaged for the purpose of propelling the vessel, or
2) a steaming light and deck-level red-green-white running lights when said switching circuitry provides indication that said auxiliary propulsion system is engaged for the purpose of propelling the vessel;

said operator controlled selection mechanism being comprised of a means to select operation of only the first red-green-white running light set and a means to select operation of both running light sets.

18. A method of claim 17 wherein the improvement is additionally comprised of a second operator controlled selection mechanism which permits a choice of mutually exclusive selections; said second operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of a steaming light and red-green-white deck-level running lights.

19. A method of claim 17 wherein the improvement is additionally comprised of a second operator controlled selection mechanism which permits a choice of mutually exclusive selections; a said second operator controlled selection mechanism being comprised of 1) a means to select said automatic selection of operation by said switching circuitry connected to said auxiliary propulsion system and
2) a means to select both a) prevention of said automatic selection of operation by said switching circuitry connected to said auxiliary propulsion system and b) operation of said running lights selected by a first said operator controlled selection mechanism of claim 17.

20. An improved method for controlling the navigation lights of a sailing vessel including a steaming light, a first set of deck-level red-green-white running lights and a second set of red-green running lights mounted at the masthead, by means of operator controlled selection mechanisms, electrically interposed between the vessel's electrical power source and the circuits of the navigation lights, which, subject to the condition of other equipment aboard the vessel, operate the navigation lights in conformity with a human operator's selection; wherein the improvement is comprised of the use of two operator controlled selection mechanisms, each of which permits a choice of mutually exclusive selections; a first said operator controlled selection mechanism being comprised of 1) a means to select operation of the steaming light and the deck-level red-green-white running lights and
2) a means to select operation of the running lights selected by a second said operator controlled selection mechanism;

a second said operator controlled selection mechanism being comprised of a means to select operation of only the first red-green-white running light set and a means to select operation of both running light sets.

* * * * *